United States Patent [19]

Vogel

[11] Patent Number: 5,025,934

[45] Date of Patent: Jun. 25, 1991

[54] STANDING CONTAINER

[75] Inventor: Helmut Vogel, Nürnberg, Fed. Rep. of Germany

[73] Assignee: A. W. Faber-Castell GmbH & Co., Stein, Fed. Rep. of Germany

[21] Appl. No.: 532,968

[22] Filed: Jun. 4, 1990

[30] Foreign Application Priority Data

Jul. 13, 1989 [DE] Fed. Rep. of Germany ..... 392310

[51] Int. Cl.[5] ..... A47F 7/00

[52] U.S. Cl. ..... 211/69.5; 211/60.1

[58] Field of Search ..... 211/69.5, 60.1, 69, 211/69.1, 69.8, 70.6; 206/371

[56] References Cited

U.S. PATENT DOCUMENTS

| | | | |
|---|---|---|---|
| 769,592 | 9/1904 | DeLong | 211/69.5 |
| 786,719 | 4/1905 | Berolzheimer | 211/69.5 |
| 2,699,262 | 1/1955 | Elliott | 211/69.8 |
| 2,812,563 | 11/1957 | Barber | 211/69.8 X |

FOREIGN PATENT DOCUMENTS

| | | | |
|---|---|---|---|
| 557874 | 8/1932 | Fed. Rep. of Germany | 211/69.8 |
| 8411099 | 9/1984 | Fed. Rep. of Germany . | |
| 8533065 | 7/1986 | Fed. Rep. of Germany . | |
| 3527778 | 2/1987 | Fed. Rep. of Germany . | |
| 158560 | 2/1933 | Switzerland | 211/69.6 |

*Primary Examiner*—Alvin C. Chin-Shue
*Assistant Examiner*—Sarah A. Lechok
*Attorney, Agent, or Firm*—Michael J. Striker

[57] ABSTRACT

A standing container for pin-shaped writing or drawing instruments comprises a plurality of receiving elements pivotally connected with one another, each of the receiving elements being formed as a strip-shaped receptacle with at least two parallel rows of insertion openings and with a groove provided on its lower side and extending in a longitudinal direction, a spring element located in the groove and provided with a plurality of individual spring tongues are arranged to abut against a pin shaped element freely lying in the region of the groove, and connecting elements for connecting the receptacles with one another and including an extension formed at an upper side and at least one longitudinal end of each of the receptacles, a hinge piece extending between the longitudinal ends of two adjacent receptacles, and a pin connecting the hinge piece to the longitudinal end of each of the receptacles.

13 Claims, 2 Drawing Sheets

FIG. 1
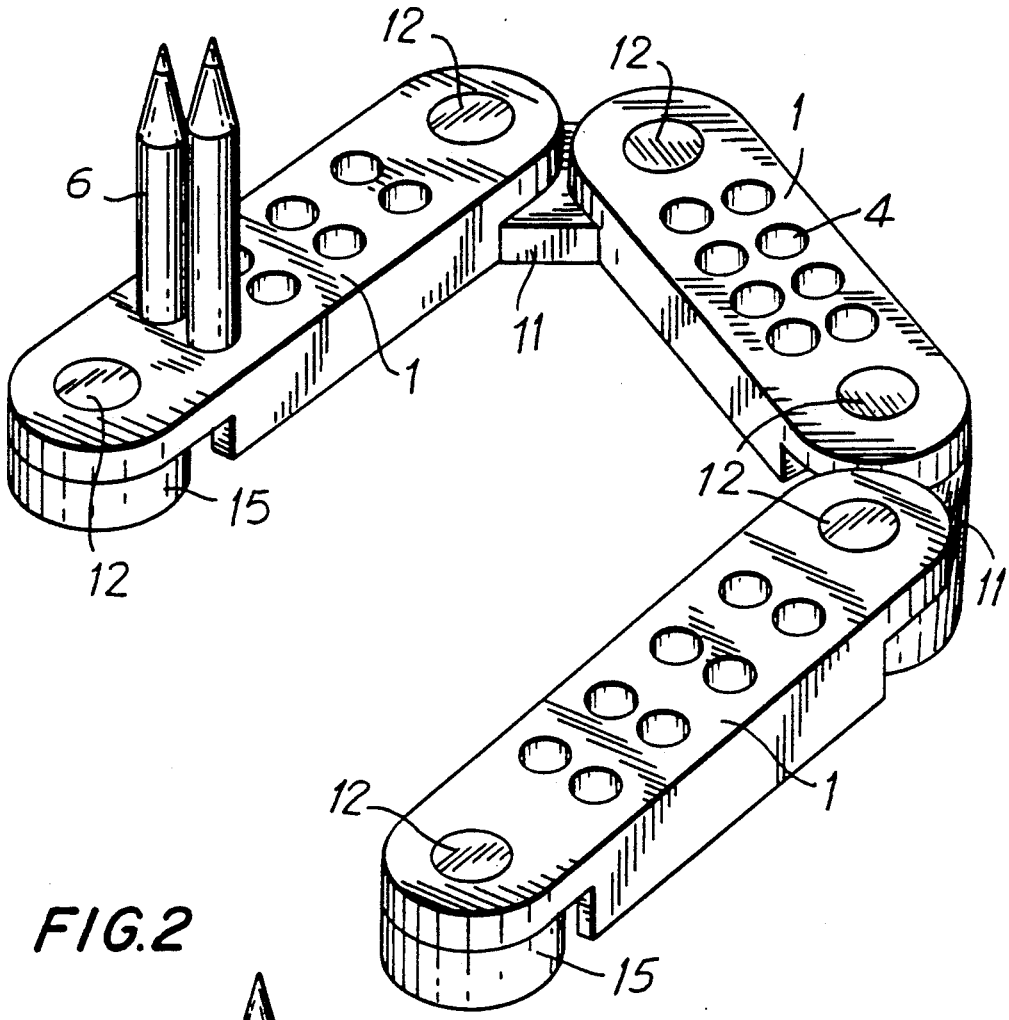
FIG.2
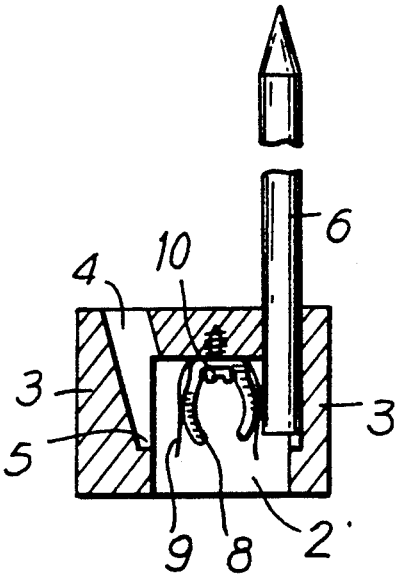
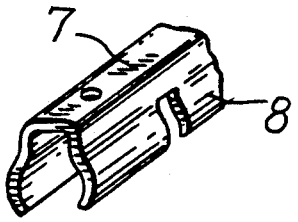
FIG. 3

STANDING CONTAINER

BACKGROUND OF THE INVENTION

The present invention relates to a standing container for pin-shaped writing or drawing instruments. More particularly, it relates to a standing container for these instruments, which has insertion openings provided in several pivotally connected receiving elements.

German reference DE-GM 8,411,099 discloses a standing container in which two or more elements are connected in their end regions by intermediate pieces. Therefore, they can move about two vertical axes up to 360°. The insertion openings provided in the receptacles are formed as blind openings. In other words, they are not throughgoing openings, moreover, they do not contain any means for clamping the inserted objects. Therefore, this container can be used only in its standing or erected position as a pure working device shaft for holding objects in ready position, for example for holding color pencils. However, during transportation the pins fall out when they are in a somewhat horizontal position.

In the field of fabrication of wood-coated lead pencils or color pencils so-called supporting frames are utilized. One of such supporting frames is disclosed for example in the German reference DE-OS 3,527,778. In this frame as many as possible pencils must be received in a small place for economical reasons. They must be mounted so that they can be inserted in the insertion openings without damages and can be withdrawn from them for use. These steps are mechanized. Therefore it is not needed to grip the pencils by hand efficiently.

SUMMARY OF THE INVENTION

Accordingly, it is an object of the present invention to provide a standing container which has a good standing property, in which the inserted pin-shaped elements are secured from falling in any position, and in which each individual pin-shaped element is well accessible for the user so that it can be easily gripped by hand for withdrawal or storage.

In keeping with these objects and with others which will become apparent hereinafter, one feature of the present invention resides, briefly stated, in a standing container in which the receiving elements are formed as strip-shaped receptacles with two parallel rows of insertion openings, each of the receptacles has a throughgoing groove extending on its lower side in a longitudinal direction, a spring element with a plurality of individual oppositely located spring tongues is located in each groove and abuts against the pin-shaped element in the region of the groove, and the upper portion of each receptacle is extended to carry a pin for rotatably supporting a hinge piece which connects the receptacles with one another.

Since the receptacles are pivotally connected with one another by hinge pieces, the receptacles can be turned relative to one another by approximately 160°. Therefore, the receptacles can assume configurations which provide for high stability of the container in its standing position. The pin-shaped elements are reliably secured from falling out by the spring elements provided in each receptacle, and at the same time, the pin-shaped elements can be easily gripped by hand since only two rows of pin-shaped elements are inserted.

It is advantageous when the pin-shaped elements inserted in the receptacle are exactly oriented in their position. This is achieved by a special construction of the insertion openings, which are provided with partially-cylindrical extension openings extending into the side legs which limit the groove. In this construction, it is especially advantageous when the length of the insertion opening and the partially-cylindrical opening is smaller than the total height of the receptacle. Therefore, a limit or stop is formed at the end of the partially-cylindrical opening.

The above mentioned limit insures that damages to the end sides of the pin-shaped elements are prevented since they are protected inside the receptacle and during shaking of the container do not slide to a lower position and a wear is excluded.

It is especially advantageous for engaging the pins when two insertion openings and the partially-cylindrical openings located opposite to one another are inclined relative one another at an angle of less than 45°. Preferably, this angle is 10°–15°. Therefore, the receptacles arranged parallel on one another occupy a smallest possible place in a package.

An exactly parallel arrangement of the receptacles on one another and the arrangement of the hinge pieces at a right angle to the receptacles is obtained when the receptacles are provided with pins at their ends, and the hinge pieces are turnably mounted on the pins over at least 180°. The side legs are made shorter than the total size of the receptacles by at least a double width of the hinge pieces.

An economical fabrication with minimizing of the different parts can be obtained when end pieces can be arranged on the pins carried by the end of the receptacles. The outer shape of the end pieces advantageously corresponds to the outer shape of the receptacles.

In accordance with still another feature of the present invention, it is advantageous when the spring elements are provided on their outer side with a cover composed for example of flexible synthetic plastic material. The cover can also be formed by a varnish-like coating to reduce the cost. With this feature, the friction property can be selected so that on the one hand a sufficient hold of the pin-shaped element is achieved by a spring pressure, and on the other hand, a favorable sliding condition during insertion of the pin-shaped elements is maintained.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view of a container in accordance with the present invention in unfolded conditon;

FIG. 2 is a view showing a cross-section of one of the receptacles of the inventive container of FIG. 1;

FIG. 3 is a partial view showing a spring strip to be received in a groove of the receptacle of the inventive container;

DESCRIPTION OF THE PREFERRED EMBODIMENTS

Figure 4:
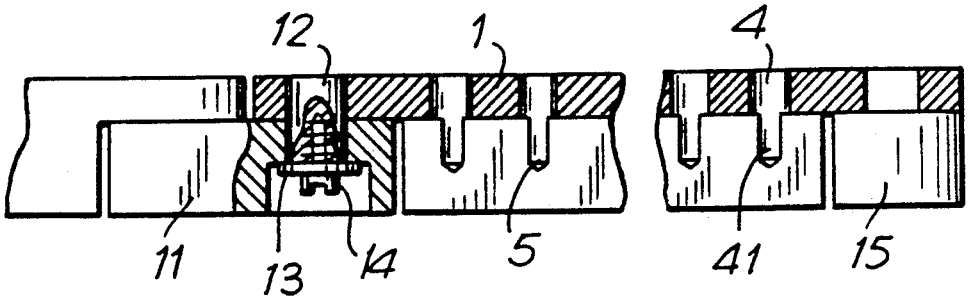
FIG. 4 is a longitudinal section of the inventive container through a connect area between two receptacles with a hinge piece.

FIG. 1 shows a container which can be arranged in a standing position and has three receptacles identified with reference numeral 1. The receptacles are connected with one another by hinge pieces 11 in a pivotable manner.

The construction of the receptacles 1 is shown in detail in FIG. 2. Each receptacle has a through groove 2 which is closed by two side legs 3 and an upper part 1.1 of the recepacle 1. Insertion openings 4 for receiving of pins 6 merge in the region of the inner side of the side leg 3 in partially-cylindrical openings 4.1. The partially-cylindrical openings 4.1 end in their lower limiting wall 5. For fixing the pins in the insertion openings 5, a spring strip 7 is provided.

The spring 7 has individual spring tongues 8. A cover 9 lies over the tongues 8 for protecting the surface of the pins from damages. The cover 9 can be composed for example of a synthetic plastic material. The spring strip 7 can be mounted in the groove 2 in a simple manner, for example by screws 10.

As can be seen from FIG. 2, the insertion opening 4 and a partially-cylindrical opening 4.1 connected therewith can also extend at an angle. The angle must be selected so that when the pin is inserted in an inclined position its freely projecting end does not extend farther than the width of the receptacle 1.

Figure 5:
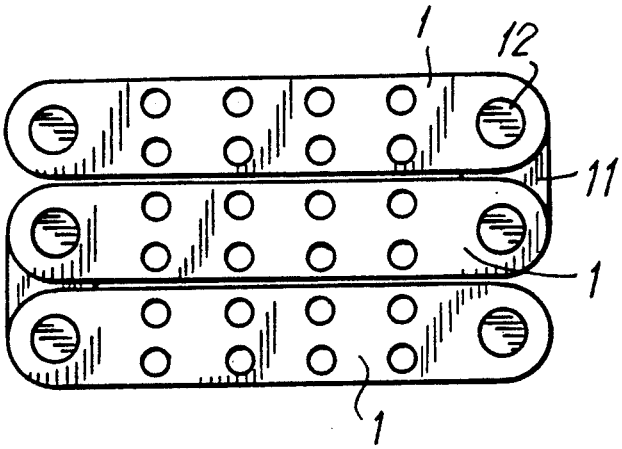
FIG. 5 is a plan view of the inventive container with three receptacles extending parallel to one another.
Figure 6:
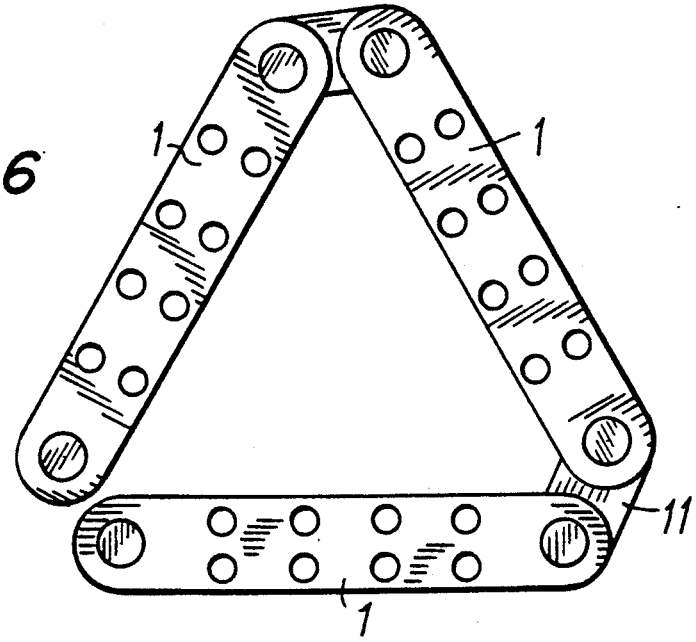
FIG. 6 is a plan view showing the inventive container with three receptacles which are arranged to form an isosceles triangle.

The connection of several receptacles 1 with one another can be performed by the hinge pieces 11. The pieces are turnably supported on pins 12 which are fixedly inserted secured in respective extensions 1.2 of the upper parts 1.1 of the receptacles 1. The length of the pins 12 which is inserted in the blind opening of the hinge pieces 11 is selected so that by the mounting with a screw 14 and a washer 13, an easily accessible turning of the receptacle 1 and the hinge piece 11 relative to one another is possible. Therefore the configurations shown in FIGS. 5 and 6 can be easily formed.

For utilizing the receptacles 1 of only one type during mounting and storage, it is advantageous to provide end pieces 15. These end pieces close the free ends of the receptacles 1 as shown in FIG. 1.

As can be seen from the drawings, the insertion openings 4 in the region above the spring tongue 8 is sufficiently long so that during frequent exchange the pins can be loosely inserted without overcoming the force of the spring tongue 8.

It will be understood that each of the elements described above, or two or more together, may also find a useful application in other types of constructions differing from the types described above.

While the invention has been illustrated and described as embodied in a standing container for writing or drawing instruments, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A standing container for pin-shaped writing or drawing instruments, comprising a plurality of receiving elements pivotally connected with one another, each of said receiving elements being formed as a strip-shaped receptacle with at least two parallel rows of insertion openings, with a groove provided on its lower side and extending in a longitudinal direction, and an upper part having an extension at least at one end thereof; a spring element located in said groove and provided with a plurality of individual spring tongues arranged to abut against pin-shaped elements lying in a region of said groove; and means for pivotally connecting said receptacle with an adjacent receptacle and including a hinge piece extending between the one ends of said receptacle and the adjacent receptacle and a pin supported by said extension and connecting a respective end of said hinge piece to the one end of said receptacle; said receptacle having a plurality of partially-cylindrical openings each forming a continuation of a respective one of said insertion openings and being located deeper than the latter, and said receptacle having side legs which limit said groove, said partially-cylindrical openings extending into said side legs.

2. A standing container for pin-shaped writing or drawing instruments, comprising a plurality of receiving elements pivotally connected with one another, each of said receiving elements being formed as a strip-shaped receptacle with at least two parallel rows of insertion openings, with a groove provided on its lower side and extending in a longitudinal direction, and an upper part having an extension at least at one end thereof; a spring element located in said groove and provided with a plurality of individual spring tongues arranged to abut against pin-shaped elements lying in a region of said groove; and means for pivotally connecting said receptacle with an adjacent receptacle and including a hinge piece extending between the one ends of said receptacle and the adjacent receptacle and a pin supported by said extension and connecting a respective end of said hinge piece to the one end of said receptacle; said receptacle having side legs which limit said groove, said hinge piece being pivotally mounted on said pin about at least 180°, each of said side legs being shorter than a total height of said receptacle by a double width of said hinge piece.

3. A standing container for pin-shaped writing or drawing instruments, comprising a plurality of receiving elements pivotally connected with one another, each of said receiving elements being formed as a strip-shaped receptacle with at least two parallel rows of insertion openings, with a groove provided on its lower side and extending in a longitudinal direction, and an upper part having an extension at least at one end thereof; a spring element located in said groove and provided with a plurality of individual spring tongues arranged to abut against pin-shaped elements lying in a region of said groove; means for pivotally connecting said receptacle with an adjacent receptacle and including a hinge piece extending between the one ends of said receptacle and the adjacent receptacle and a pin supported by said extension and connecting a respective end of said hinge piece to the one end of said receptacle; and a cover provided on an outer side of said spring element.

4. A container as defined in claim 3, wherein said cover is composed of a flexible, synthetic plastic material.

5. A standing containing for pin-shaped writing or drawing instruments, comprising a plurality of receiving elements pivotally connected with one another, each of said receiving elements being formed as a strip-shaped receptacle including at least two parallel rows of insertion openings, a lower part having a through groove extending therein in a longitudinal direction of said receptacle, and an upper part having at least at one end thereof an extension which is free from insertion openings and extends beyond said lower part; a spring element located in said through groove and provided with a plurality of individual spring tongues arranged to abut against pin-shaped elements extending through said insertion openings; and means for pivotally connecting said receptacle with an adjecent receptacle and including a hinge piece extending between the one ends of said receptacle and the adjacent receptacle, and a pin supported by said extension and pivotally connecting a respective end of said hinge piece to the one end of said receptacle.

6. A container as defined in claim 5, wherein said spring element is formed as a spring strip having a U-shaped contour.

7. A container as defined in claim 5, wherein each of said receptacles has a plurality of partially-cylindrical openings each forming a continuation of a respective one of said insertion openings and being located deeper than the latter.

8. A container as defined in claim 7, wherein each of said receptacles has a predetermined height, said insertion openings and said partially-cylindrical openings are smaller than the height of said receptacles so that a stop is formed at a lower end of each of said partially-cylindrical openings.

9. A container as defined in claim 7, wherein two of said insertion openings and partially-cylindrical openings located opposite to one another in a direction transverse to the longitudinal direction of each of said receptacles are arranged relative to one another at an angle of less than 45°.

10. A container as defined in claim 9, wherein the angle at which said insertion openings are inclined relative to one another amounts to substantially 10°–15°.

11. A container as defined in claim 5, wherein the upper part of at least one of the receptacles has another extension at another end thereof, said container further comprising an end piece located beneath said another extension.

12. A container as defined in claim 11, further comprising another pin extending through said another extension for supporting said end piece.

13. A container as defined in claim 11, wherein said at least one receptacle has a central area having a predetermined cross-sectional shape, and said another end of the upper part of said at least one receptacle having another cross-sectional shape, said end piece having a cross-sectional shape such that it complements the another cross-sectional shape of said another end to the predetermined cross-sectional shape of the central area of said at least one receptacle.

* * * * *